US006170250B1

(12) United States Patent
Hara et al.

(10) Patent No.: US 6,170,250 B1
(45) Date of Patent: Jan. 9, 2001

(54) STRUCTURE FOR CONNECTING BLOCKS OF BAND

(75) Inventors: Toshiaki Hara, Kitakami; Jindai Yamakawa, Tanashi, both of (JP)

(73) Assignee: Citizen Watch Co., Ltd., Tokyo (JP)

( * ) Notice: Under 35 U.S.C. 154(b), the term of this patent shall be extended for 0 days.

(21) Appl. No.: 09/147,719

(22) PCT Filed: Jun. 25, 1998

(86) PCT No.: PCT/JP98/02863

§ 371 Date: Feb. 24, 1999

§ 102(e) Date: Feb. 24, 1999

(87) PCT Pub. No.: WO99/00031

PCT Pub. Date: Jan. 7, 1999

(30) Foreign Application Priority Data

Jun. 27, 1997 (JP) ..... 9-186047
Oct. 6, 1997 (JP) ..... 9-287594

(51) Int. Cl.[7] ..... F16G 13/16
(52) U.S. Cl. ..... 59/80
(58) Field of Search ..... 59/80, 81, 78, 59/82

(56) References Cited

U.S. PATENT DOCUMENTS 1,822,894 * 9/1931 Kestenman ..... 59/80
3,482,394 * 12/1969 East ..... 59/80
3,609,963 * 10/1971 Ichinose ..... 59/80

FOREIGN PATENT DOCUMENTS 52-24971 * 2/1977 (JP) .
52-24452 * 6/1977 (JP) .
53-14216 * 4/1978 (JP) .
55-11694 * 3/1980 (JP) .
56-86018 * 7/1981 (JP) .
2-7643 * 2/1990 (JP) .

* cited by examiner

*Primary Examiner*—David Jones
(74) *Attorney, Agent, or Firm*—Dennison, Scheiner, Schultz & Wakeman

(57) ABSTRACT

A link is made by bending a metal plate, and comprises a plurality of annular portions (13, 14, 15) and connecting portions (12) between the annular portions. An annular connecting link (3) has a gap through which the connecting portion passes and engaged with the connecting portion. A connecting member (4) having a base (41), a connecting arm (43), and an end portion is provided to be inserted between the link and the connecting link so as to connect the connecting link to the link with the connecting arm. A stopping means (17,42) is provided for holding and stopping the connecting member within the link. An opening is provided for disclosing an outer surface of the end portion of the connecting member from one of the annular portions at an end thereof, so as to allow a tool (5) to push the connecting member.

19 Claims, 11 Drawing Sheets

STRUCTURE FOR CONNECTING BLOCKS OF BAND

TECHNICAL FIELD

The present invention relates to a structure of a band comprising a plurality of links connected together used for wearing a personal adornment such as a wrist watch and a bracelet, and more particularly to a connecting structure where certain of the links can be easily attached and detached to adjust the length of the band.

BACKGROUND ART

A typical conventional structure for connecting links of a band made of metal plate is described with reference to FIG. 12. The figure is an exploded perspective view of a part of the band, drawn to show the underside thereof upward.

A link 60 is formed by shaping a metal plate cut and machined beforehand into a square tube, and comprises three annular portions 61, 62 and 63 at the ends and the center thereof, and connecting portions 64 connecting the annular portions. An engaging recess 66 is formed at the inner portion of the annular portion 63 provided at the end. When the link 60 is formed into the tube, a core 67 is wrapped in and clasped by the other annular portion 61 so as to block the opening of the link 60, hence being secured therein. A connecting link 68 has a gap 70 through which the connecting portion 64 of the link is inserted, thereby sequentially connecting the links 60.

A connecting member 71 substantially has a U-shape, and comprises a base 72, engaging projection 73 formed on the axis of symmetry, and a pair of connecting arms 74. The connecting member 71 is inserted into the inner space of the link 60 from an end opening 75. The engaging projection 73 renders an abutting portion 76 adjacent the annular portion 63 to slightly yield, overcoming the resistance thereof, and then engages in an outer end portion of the engaging recess 66, thereby preventing disengagement. During the course of insertion, each of the connecting arms 74 penetrates the two of the adjacent two pairs of connecting links 68, so that the connection of each link is completed.

In the conventional structure, in order to remove or add a link to adjust the length of the band, a part of the connected links must be temporarily disengaged. In order to detach a link, a rod-shaped tapered tool 77 is diagonally inserted in the engaging recess 66 of the link 60 as shown in the drawing, and forcefully pushes the bottom of the U-shape of the connecting member 71 in the outer direction. Thus, the connecting member 71 is pushed outward from the band. The engaging projection 73 overcomes the resistance of the abutting portion 76 and is forced outward. The connecting member 71 is then taken out by such a tool as pliers. Thus the link can be detached.

During the detaching operation, the tool 77 is pushed diagonally so that the effective force for pushing out the connecting member 71 is a horizontal component of the pushing force exerted by the tool 77, amounting only to several tens of percentages thereof. Although there is also generated a normal component of the pushing force amounting to several tens of percentages thereof, such a force increases the coefficient of friction between the connecting member 71 and the link so that the pulling force must be increased. When the tool 77 is inserted at an angle of 45°, horizontal and normal component are each about 71 percent of the pushing force exerted by the tool. In addition, the engaging projection 73 must cover a long distance to overcome the abutting portion 76. Namely, a large operating force and a relatively long stroke must be applied to the tool 77, and it is difficult to pull out the connecting member 71, and the tool may slip, causing a damage to the band.

Furthermore, in the conventional structure, the engaging recess 66 and the engaging projection 73 engaged with the recess 66 are apparent from the underside of the band, thereby deteriorating the appearance of the underside of the band. In addition, the engaging recess 66 gives a rugged feel to the wrist or catches the skin and hair, so that the band cannot be comfortably worn.

An object of the present invention is to provide a structure for connecting links of a band formed by shaping a metal plate, wherein the above described defects of the conventional structure are overcome, so that the connecting member can be pulled out with a small force, the appearance of the underside of the band improved, and the width of the band can be decreased.

DISCLOSURE OF THE INVENTION

According to the present invention, there is provided a connecting structure of a link having a plurality of annular portions and connecting portions between the annular portions, an annular connecting link having a gap through which the connecting portion passes and engaged with the connecting portion, a connecting member having a base, a connecting arm, and an end portion, the connecting member being provided to be inserted between the link and the connecting link so as to connect the connecting link to the link with the connecting arm, stopping means for holding and stopping the connecting member within the link, and disclosing means for disclosing an outer surface of the end portion of the connecting member from one of the annular portions at an end thereof, so as to allow a tool to push the connecting member.

The connecting member may substantially have a U-shape having a pair of connecting arms, or may comprise a pair of L-shaped members inserted in the link in point symmetry.

The stopping means comprises a projection and a recess which are formed on a side of the base of the connecting member and on the inner wall of the annular portion at an end so as to be mutually engaged.

The link further comprises a core partially blocking an opening of the annular portion at an end, the core forming at a side thereof a tool inserting passage as the disclosing means.

The length of the connecting member is preferably smaller than the length of the link, and the end portion of the connecting arm is retreated from the outer edge of the end annular portion, thereby forming a tool introducing recess.

The connecting arm of one of the L-shaped member may be bent at halfway of the arm in the direction of the thickness thereof so that an end thereof abuts on the inner wall of the link.

The recess and the projection are formed on an extended line of the connecting arm.

The recess or the projection formed on the annular portion is formed so as not to deform the outer surface thereof.

The connecting arm comprises a shoulder opposite the core and an inserting portion inserted in a tool inserting passage.

BEST MODE FOR EMBODYING THE INVENTION (First Embodiment)

Figure 1:
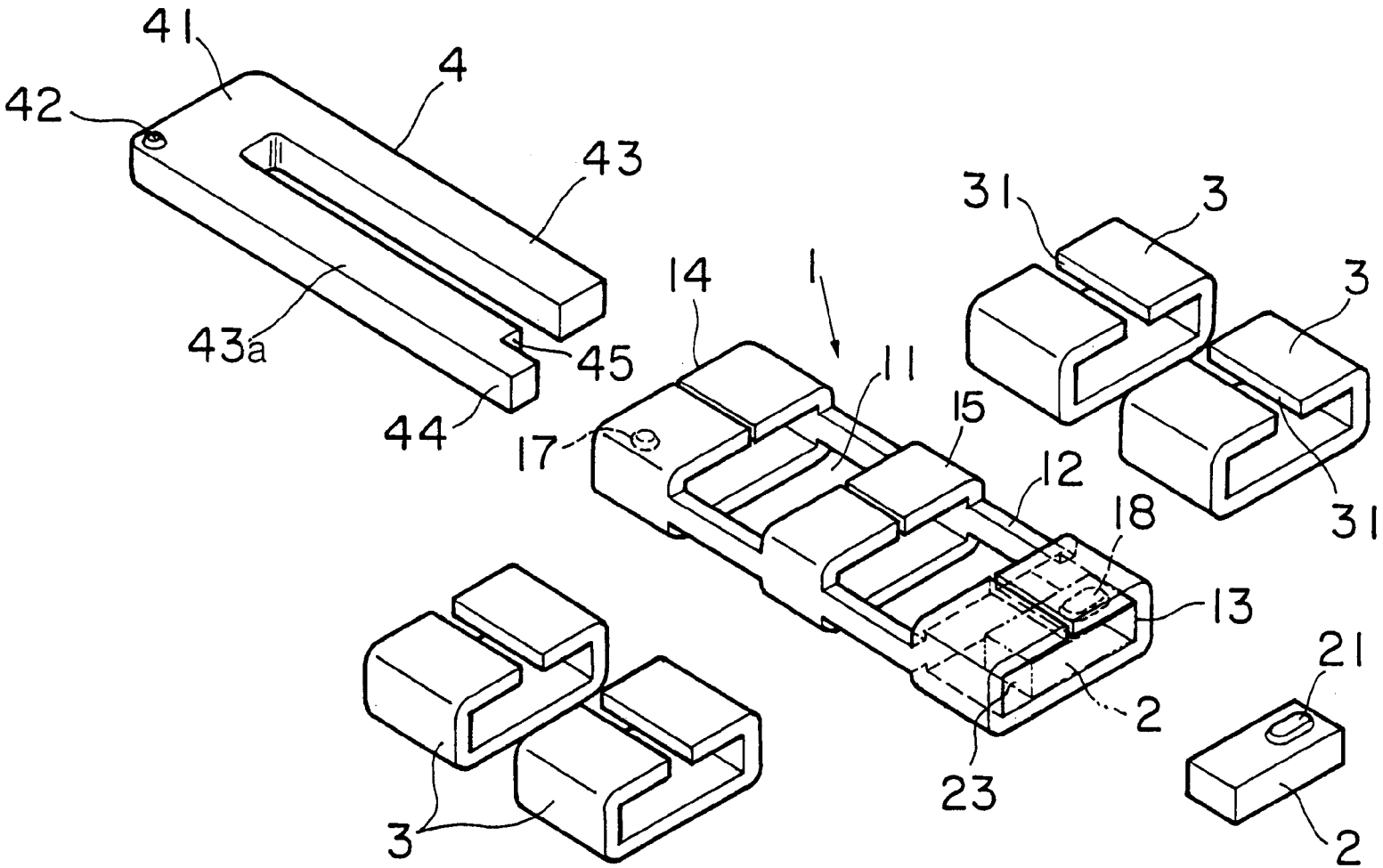
FIG. 1 is an exploded perspective view of the main part of a connecting structure of a band made of metal plate.
Figure 2A:
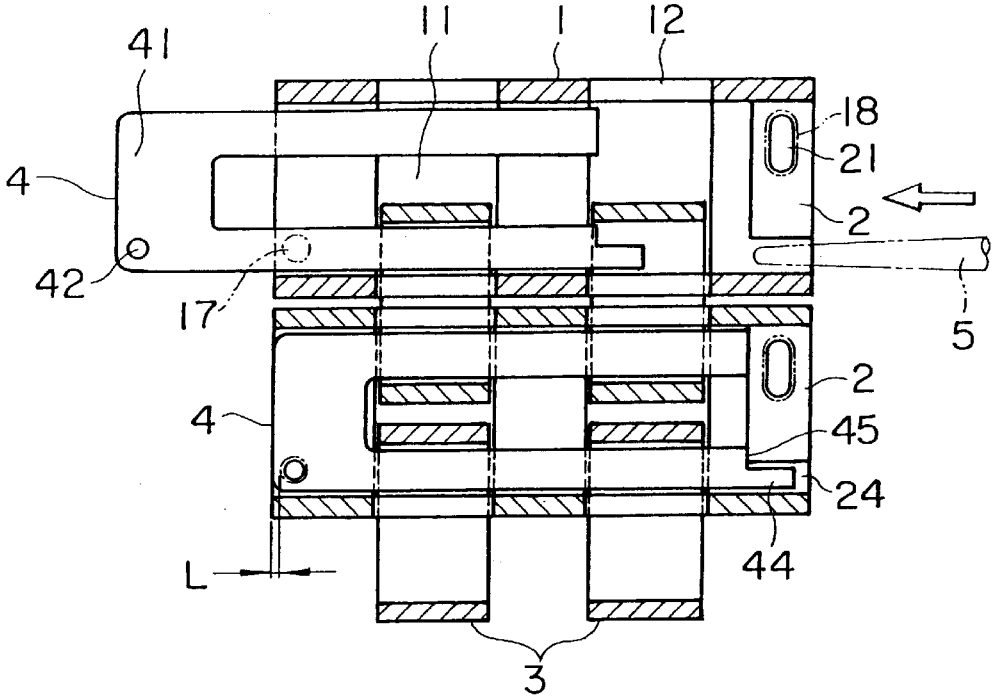
FIG. 2*a* is a sectional plan view of the assembled band.
Figure 2B:
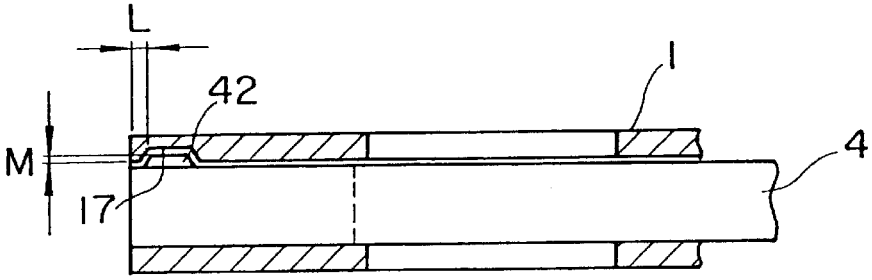
FIG. 2*b* is a sectional side view of a part of a link.
Figure 2C:
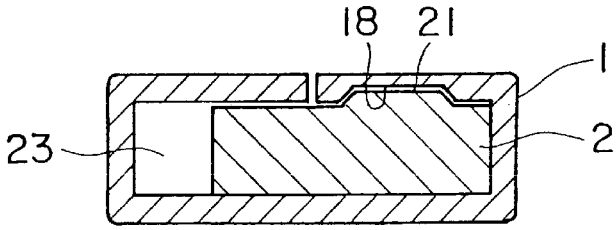
FIG. 2*c* is a sectional elevational view of a link showing a core.

FIG. 1 is an exploded perspective view of the main part of a connecting structure of a band made of metal plate, FIG. 2*a* is a sectional plan view of the assembled band, FIG. 2*b* is a sectional side view of a part of a link, and FIG. 2*c* is a sectional elevational view of a link showing a core.

A link 1 is formed by shaping a metal plate which is cut and machined beforehand, into a tube having a square section, and comprises three annular portions 13 and 14 at the ends thereof, an annular portion 15 at the center thereof, and a connecting portions 11 formed between the annular portions at both sides of the annular portion with respect to the longitudinal direction of the band.

A core 2 which is inserted inside the annular portion 13 of the link 1 has a small width with respect to the longitudinal direction of the band and is disposed at one of the sides of the annular portion 13, thereby forming an inserting passage 23 at the other side. On the underside of the core 2, there is formed a securing projection 21 which engages with a recess 18 of the annular portion 13, so that the core 2 is prevented from falling out. Each of the recess 18 and the projection 21 is formed in the shape of an elongated circle, thereby rendering a securing force in the disengaging direction sufficiently larger than a securing force with which a connecting member 4 is held. Since the recess 18 does not penetrate through the wall to the underside surface of the link 1, the appearance of the underside of the band and the feel when worn are not deteriorated. Each recess can be formed by punching and end milling.

A connecting link 3 has the same construction as the conventional connecting link. Namely, the connecting portion 12 is inserted in a gap 31 and the connecting link is housed in a space 11.

The connecting member 4 has a pair of connecting arms 43 and 43*a*. A tip end of the connecting arm 43*a* has a narrow inserting portion 44. A shoulder 45 is formed due to the difference in the widths of the connecting arm 43*a* and the inserting portion 44. A stopper projection 42 is formed on a base 41 on the side having the inserting portion 44, namely on the extension of the center axis of the inserting passage 23. On the other hand, a recess 17 is formed on an inner wall of the annular portion 14 to correspond to the projection 42.

When inserting the connecting member 4 in a space 11 from the side of the annular portion 14, the inserting portion 44 is inserted in the inserting passage 23 and stops when the shoulder 45 abuts on the core 2. As shown in FIG. 2*b*, the stopper projection 42 engages with the recess 17 so that the link 1 and the connecting link 3 are connected with each other. The inserting portion 44 and the core 2 are so designed as not to abut against each other.

As shown in FIG. 2*a*, the length of the inserting portion 44 is smaller than the width of the core 2 in the lateral direction thereof, so that when the connecting member 4 is pushed inside until the shoulder 45 abuts against the core 2, there is formed a shallow recess, namely a tool guiding recess 24, at the entrance of the inserting passage 23.

In order to disengage the link 1, the connecting members 4 in the adjoining links 1 must be removed. For the purpose of removing each connecting member 4, a rod-shaped tool 5 is inserted in the recess 24 to push the inserting portion 44 of the connecting member 4. The pushing direction completely coincides with the removing direction so that the pushing force is used hundred percent without any loss. Since the position of the stopper projection 42 of the connecting member 4 is formed on the extension of the axis of the inserting passage 23, a component of the pushing force which increases the friction is hardly generated. Hence, the connecting members 4 and the link 1 can be disengaged with a small pushing force. In addition, the stroke of the tool 5 is decreased. Furthermore, the tool guiding recess 24 prevents the tool 5 from deviating the tip thereof so that the band is not impaired.

The inserting portion 44 and the core 2 are spaced apart so as not to make a contact with one another. Therefore, when the connecting member 4 is taken out, there is no resistance by the frictional force which is caused when the connecting member 44 rubs against the core 2. This also contributes to facilitating of the disengagement between the connecting member 4 and the link 1.

Describing examples of the dimensions of each of the members, the thickness of the plate of the link 1 is 0.6 mm, the depth of the recess 17, 0.3 mm, and an engaging quantity M between the projection and the recess 0.15 mm. The securing force of the recess 17 does not change with the difference in distance between the end portion of the link 1 and the edge of the stopper projection 42. However, the decrease of the distance L causes the connecting member to be removed with ease.

(Second Embodiment)

Figure 3:
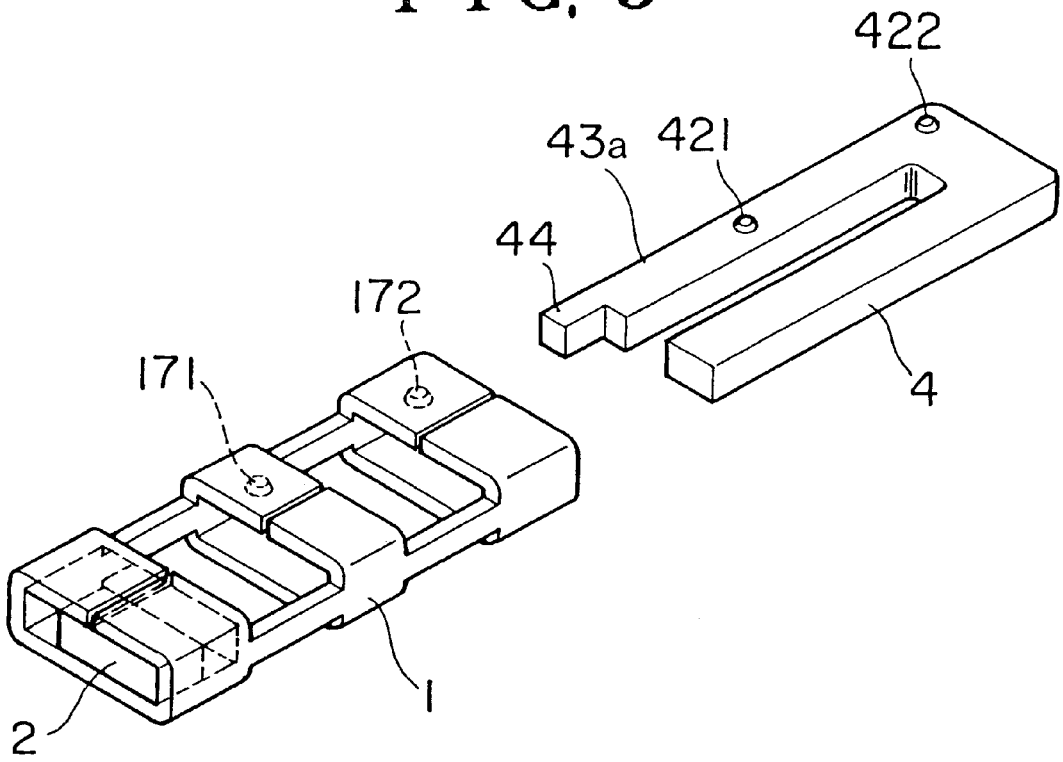
FIG. 3 is an exploded perspective view of the main part of a connecting structure of a second embodiment of the present invention.

FIG. 3 is an exploded perspective view of the main part of a connecting structure of the second embodiment of the present invention. On the surface of an arm 43*a* having an inserting portion 44, two stopper projections 421 and 422 are formed, the projections provided to engage with respective corresponding recesses 171 and 172 formed on the inner wall of a link 1 formed apart from one anther. Hence, a connecting member 4 can be securely held.

Figure 12:
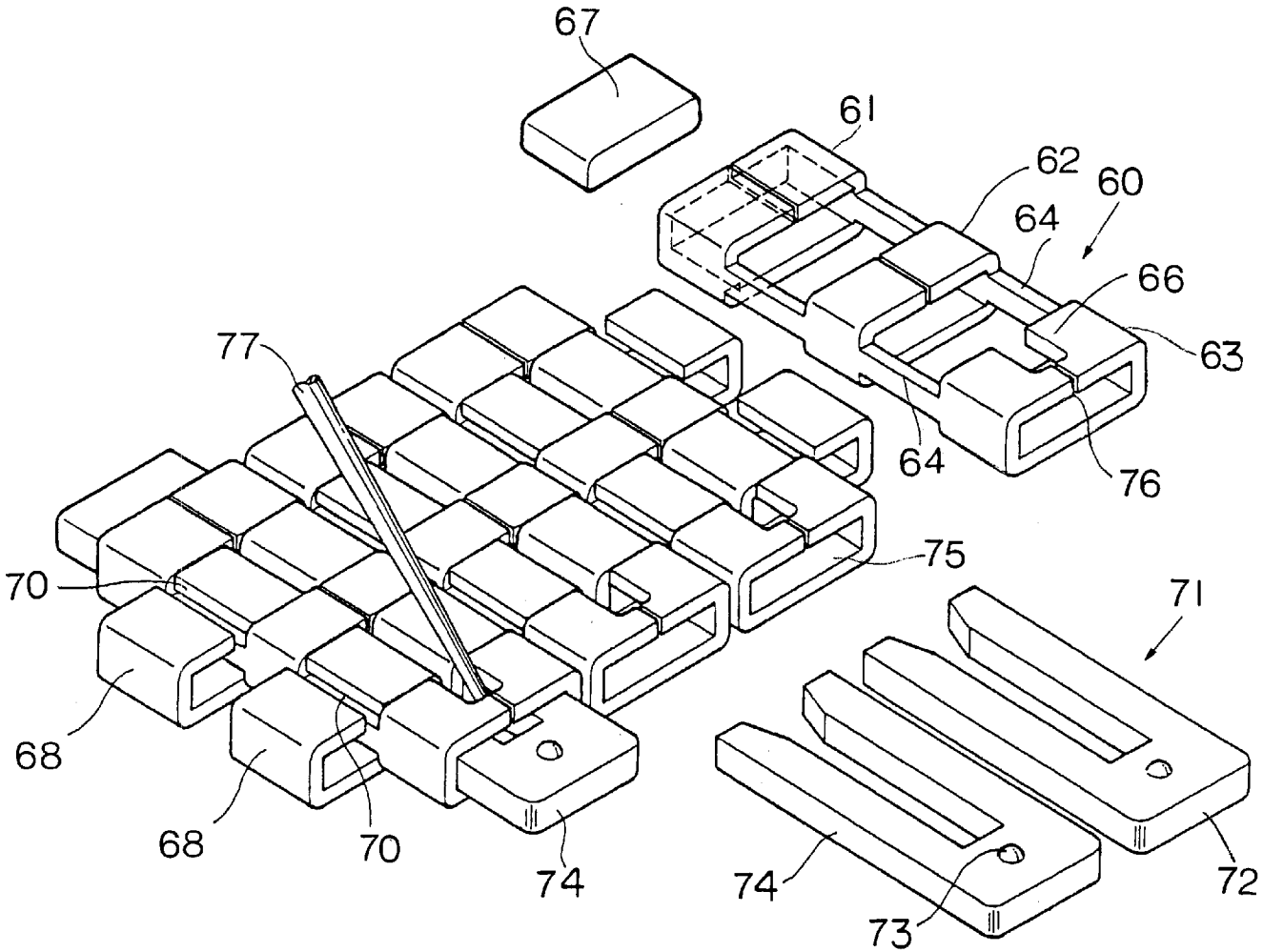
FIG. 12 is an exploded perspective view of a part of a conventional band.

In the conventional link of FIG. 12, the engaging projection 73 must be formed at the center of the base 72. However, in the present invention, the projection may be formed at other positions like the projection 421 of the second embodiment.

(Third Embodiment)

Figure 4:
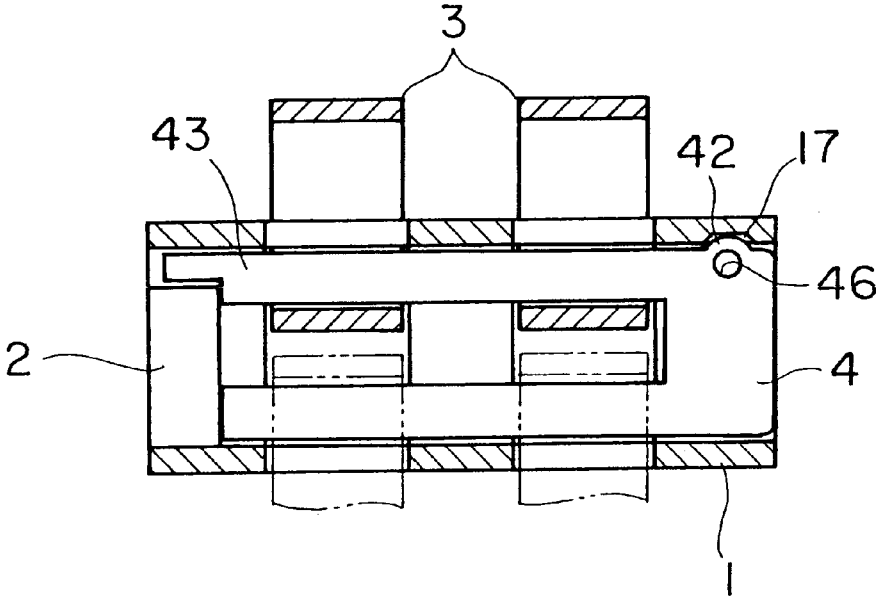
FIG. 4 is a sectional plan view of the main part of a connecting structure of a third embodiment, sectioned in the horizontal direction.

FIG. 4 is a sectional plan view of the main part of a connecting structure of the third embodiment, sectioned in the horizontal direction. In the present embodiment, the stopper recess and the projection formed on the link 1 and the connecting member 4 are positioned on the side walls of the link. A hole 46 is provided to impart flexibility to a stopper projection 42, so that the securing force and the removing force becomes appropriate quantities, thereby enabling the connecting member to be smoothly attached and detached.

(Fourth Embodiment)

Figure 5A:
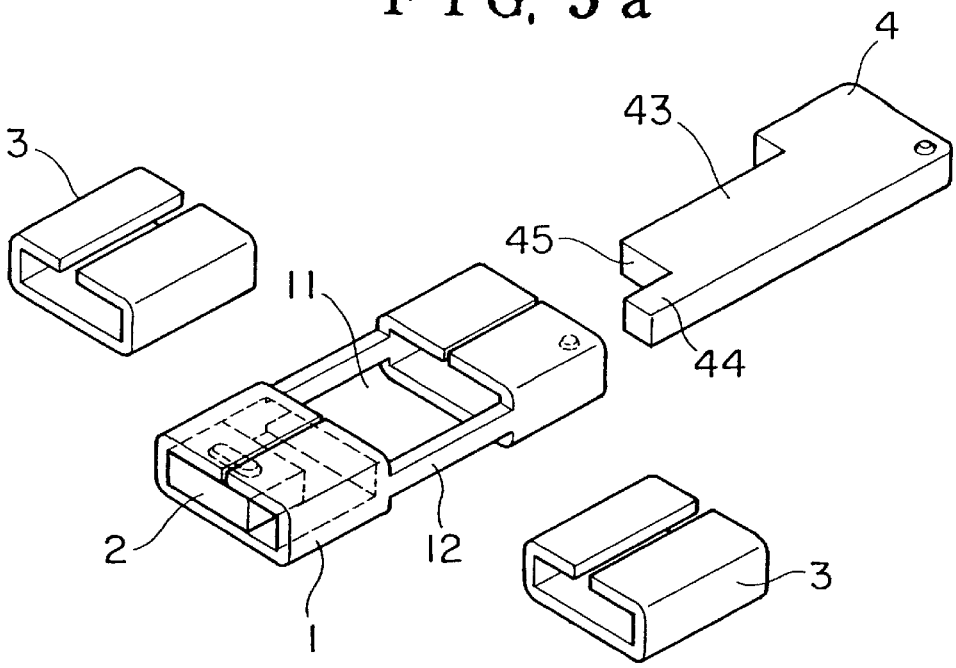
FIG. 5*a* is an exploded perspective view of the main part of a connecting structure of a fourth embodiment of the present invention.
Figure 5B:
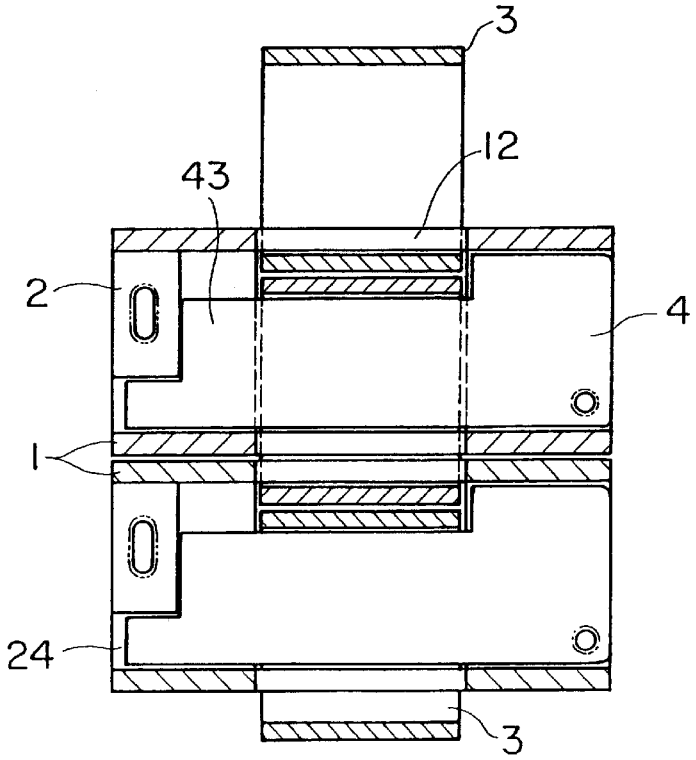
FIG. 5*b* is a sectional plan view of the assembled band of the fourth embodiment.

FIG. 5*a* is an exploded perspective view of the main part of a connecting structure of the fourth embodiment of the present invention, and FIG. 5*b* is a sectional plan view of the assembled band thereof. In the present embodiment, a connecting member 4 has only one connecting arm 43. Hence the connecting arm penetrates through only one of the sides of a connecting link 3, and the other side of the connecting link 3 engages only with a connecting portion 12 of an adjacent link 1.

(Fifth Embodiment)

Figure 6:
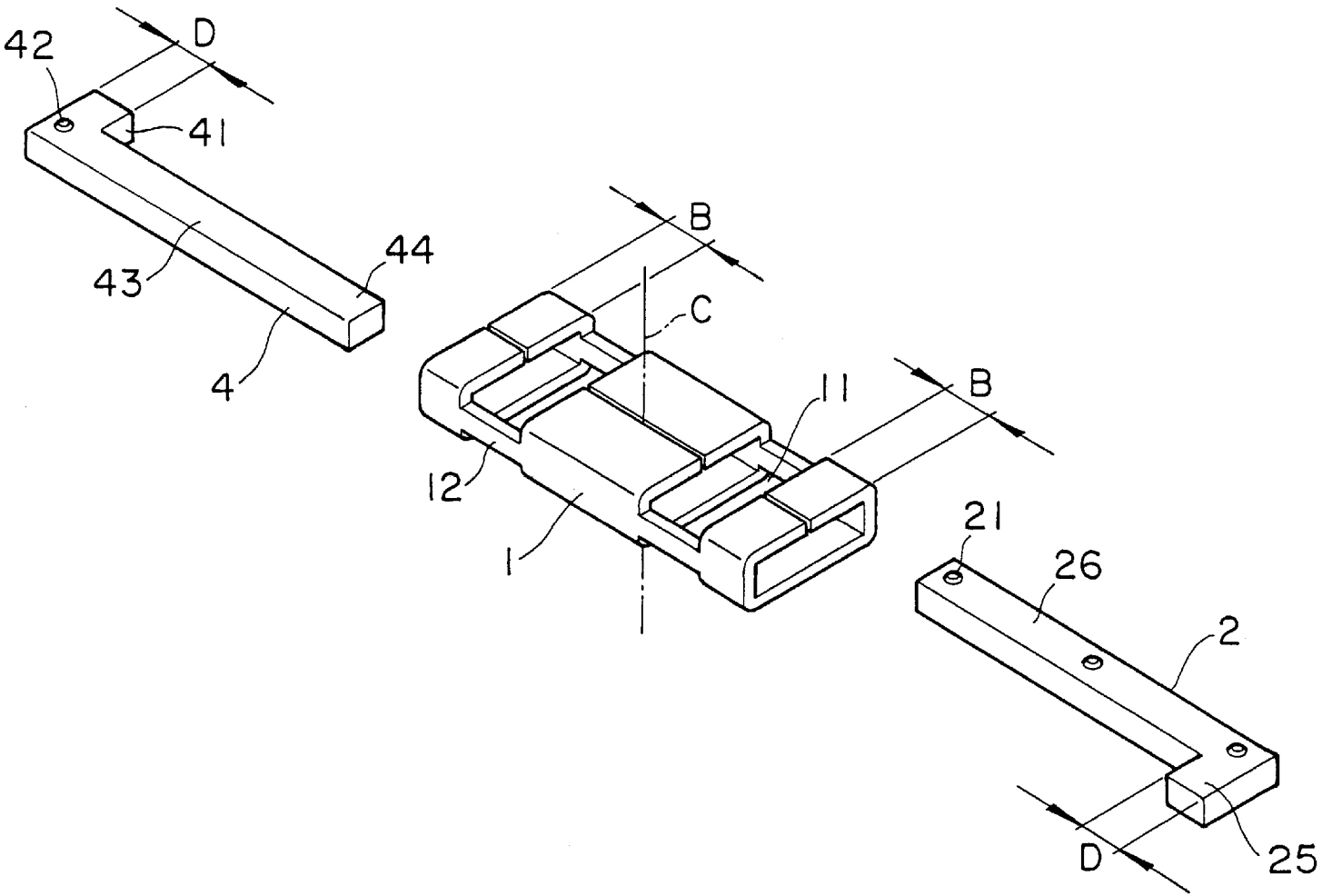
FIG. 6 is an exploded perspective view of the main part of a connecting structure of a fifth embodiment of the present invention.
Figure 7:
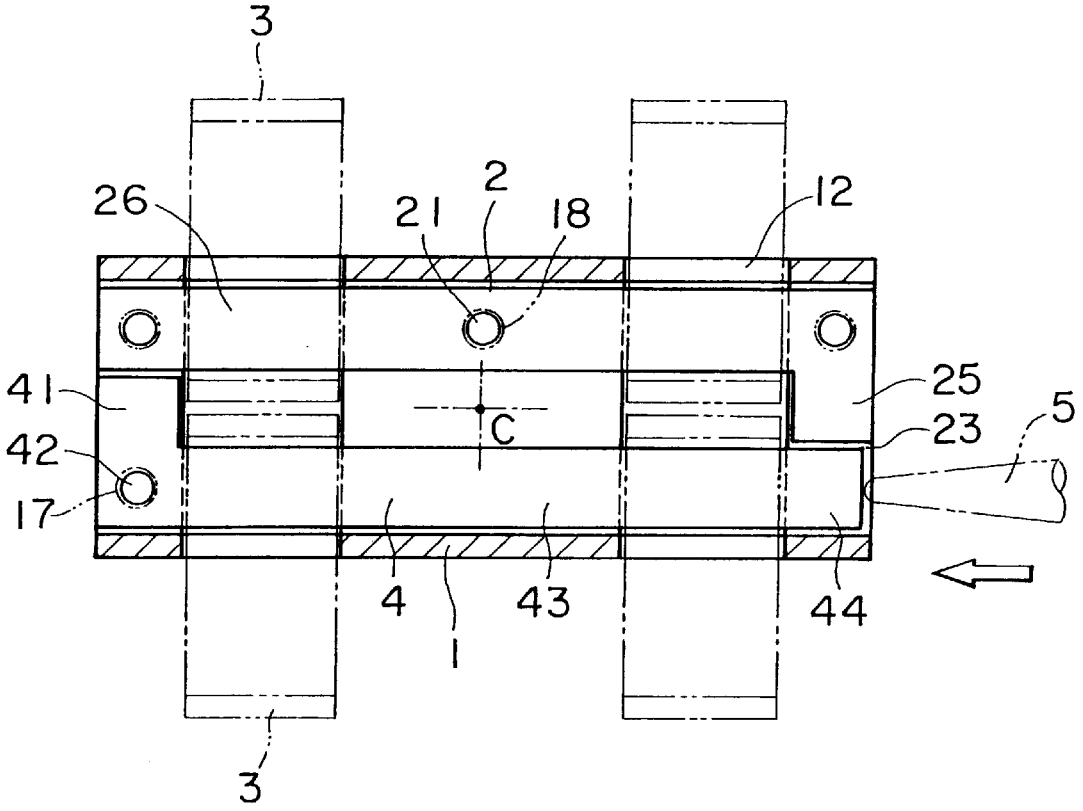
FIG. 7 is a sectional plan view of the assembled band of the fifth embodiment.

FIG. 6 is an exploded perspective view of the main part of a connecting structure of the fifth embodiment of the present invention, and FIG. 7 is a sectional plan view of the assembled band thereof. In the present embodiment, a core 2 and a connecting member 4 each has an L-shape.

A core 2 comprises a base 25 which blocks most of the one of the tubular end openings of a link 1, and a connecting arm 26 which extends in the longitudinal direction of the link 1. Three securing projections 21 are formed on the connecting arm 26.

A connecting member 4 comprises a similar base 41 and a similar connecting arm 43 to a core 2, and at an intersection of the axis of a connecting arm 43 and the axis of the base 41, a stopper projection 42 is formed. Needless to say, each projection engages the recess formed in the inner wall of the link 1 at the corresponding position. Even if the recesses and the projections are all shaped the same, due to the difference in the numbers thereof, the securing force of the core 2 to the link 1 is sufficiently stronger than that of the connecting member 4.

A width B of the outer end annular portion of the link 1 is substantially equal to widths D of the base 25 of the core and the base 41 of the connecting member 4. Moreover, since an operation of inserting the tool 77 shown in FIG. 12 of the convention structure is not needed, the widths B and D can be substantially decreased than in the conventional structure. Thus the width of the band can be decreased.

As shown in FIG. 7, the core 2 and the connecting member 4 are disposed in the link 1 in point symmetry with respect to a point C, and the connecting arms 26 and 43 are inserted in and engaged with different connecting links 3 at the opposite sides of the link 1. In order to disengage the adjoining links 1, the inserting portion 44 which is the tip end of the connecting arm 43 of the connecting member 4 is pushed with the tool 5 in the direction shown by the arrow.

In the present embodiment, since the core 2 has the same shape as the connecting member 4, the operator may erroneously push the core 2. An excessively large force is required to disengage the core 2, if not impossible. In order to prevent such an operation, although not shown in the figure, a mark such as an arrow indicating the pushing direction may be marked on the surface of the link 1, or a mark such as a dot may be marked on the end surface of the connecting arm 43, or as shown in the figure, the length of the connecting arm 43 may be shortened so as to form a recess for introducing the tool. Alternatively, the core 2 and the connecting portion 4 may be manufactured in different colors so that each can be identified.

(Sixth Embodiment)

Figure 8:
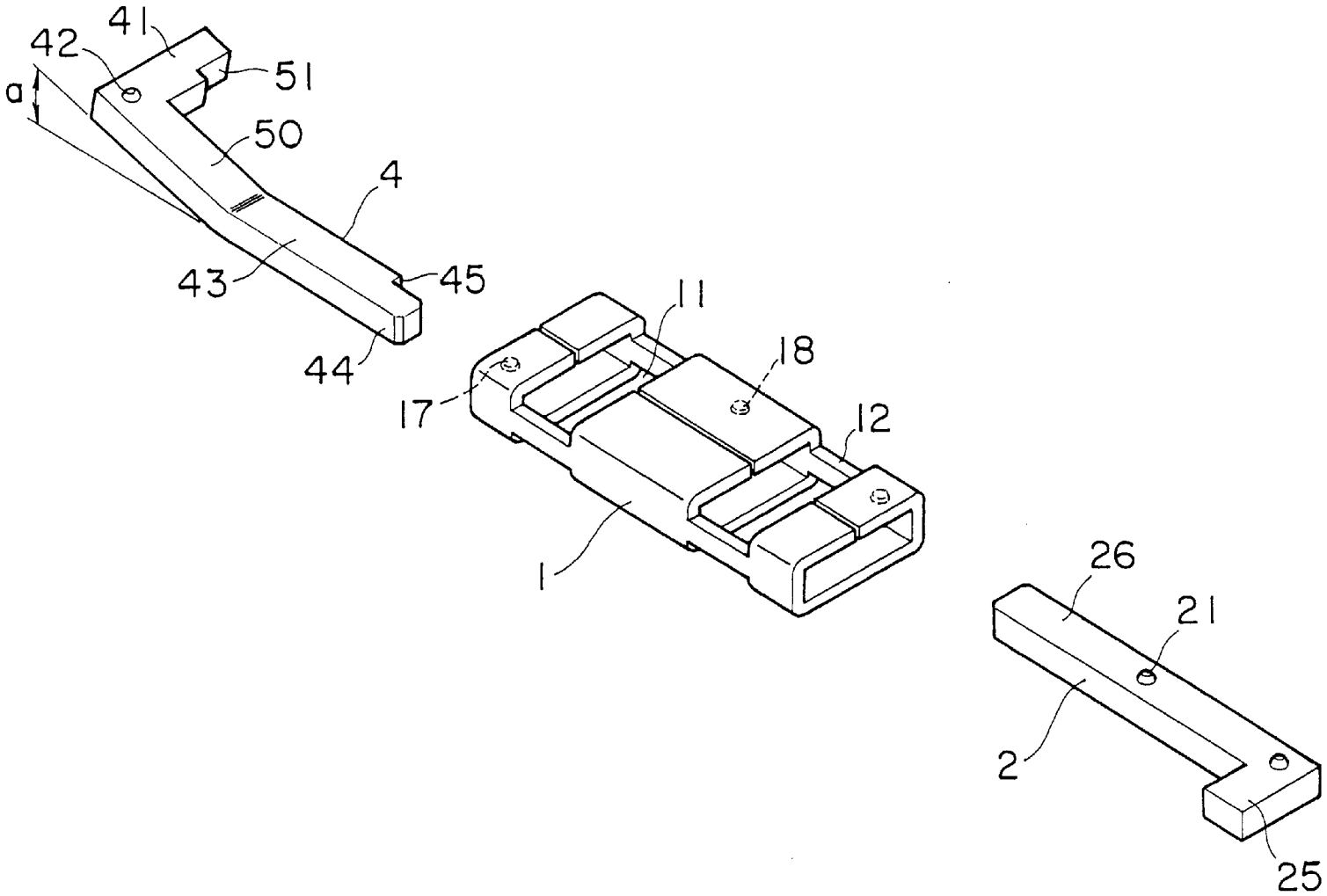
FIG. 8 is an exploded perspective view of the main part of a connecting structure of a sixth embodiment of the present invention.
Figure 9:
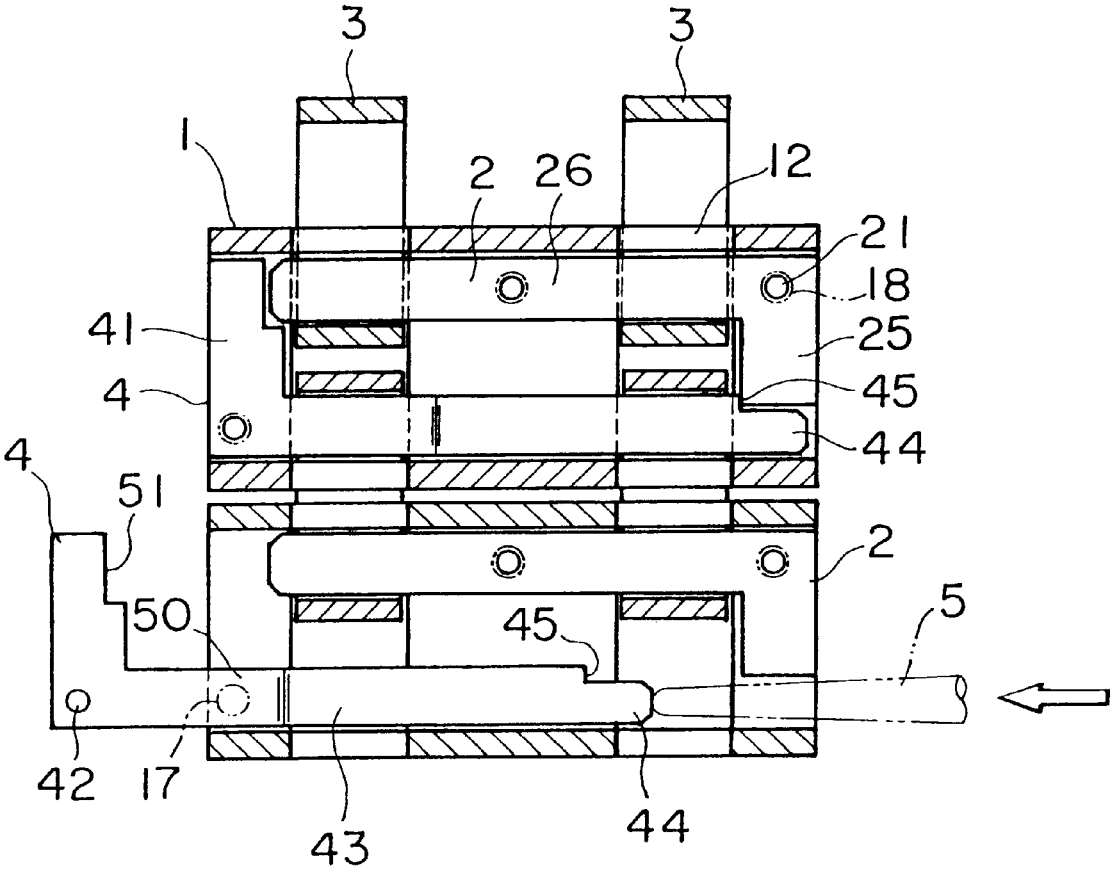
FIG. 9 is a sectional plan view of the assembled band of the sixth embodiment.
Figure 10A:
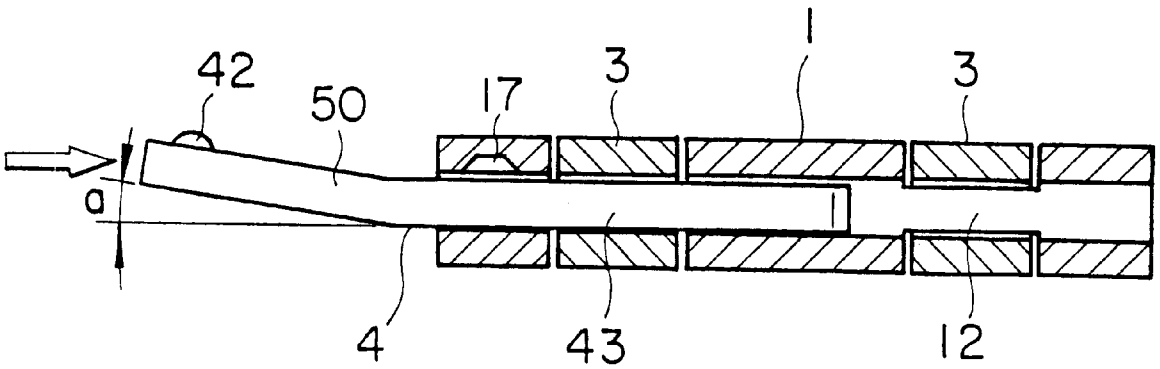
FIG. 10*a* is a sectional view showing an inserted connecting member in the sixth embodiment.
Figure 10B:
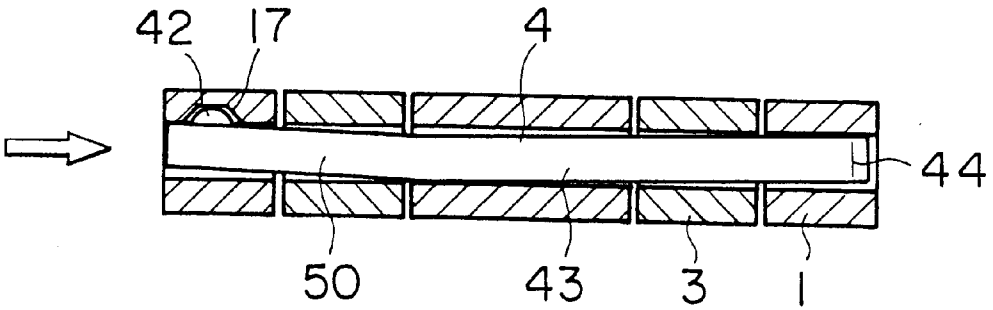
FIG. 10*b* is a sectional view showing the completely inserted connecting member.
Figure 11:
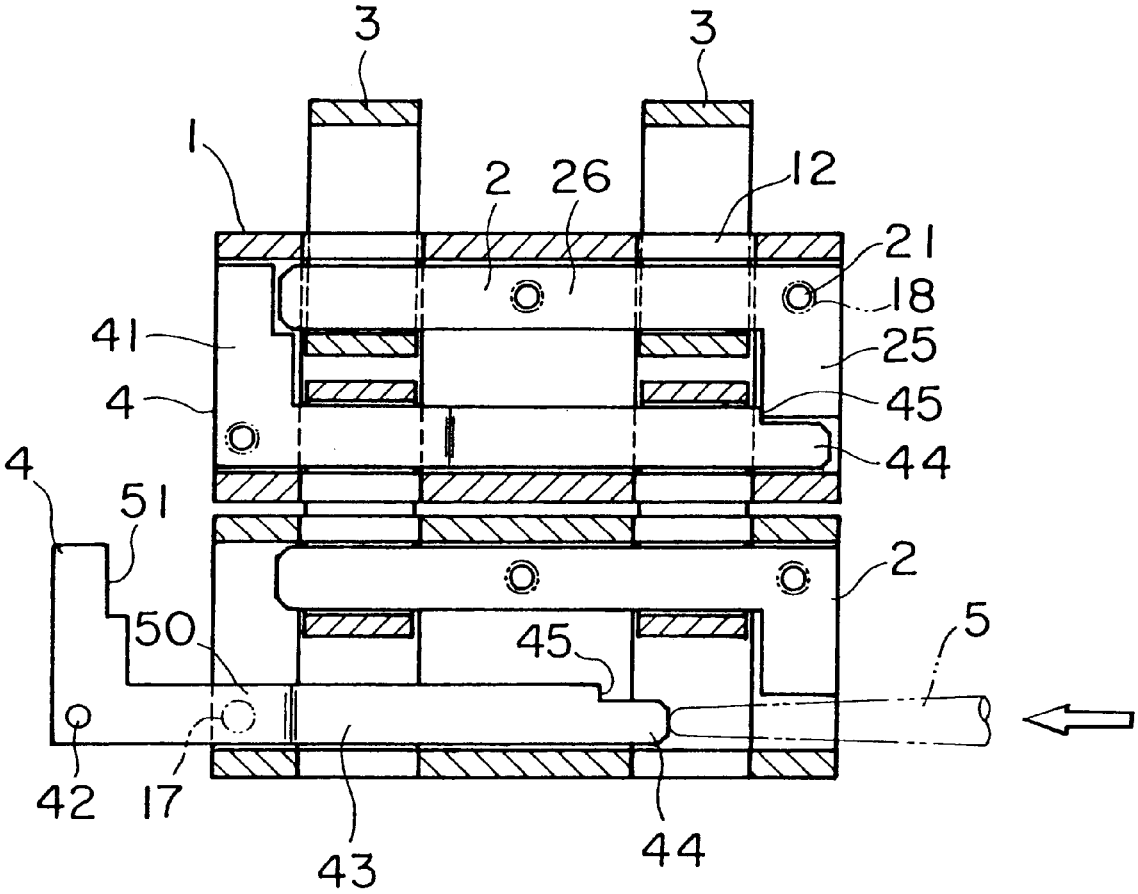
FIG. 11 is a sectional plan view of a modification of the sixth embodiment where a shoulder is obviated.

FIG. 8 is an exploded perspective view of the main part of a connecting structure of the sixth embodiment of the present invention, FIG. 9 is a sectional plan view of the assembled band thereof, FIG. 10*a* is a sectional view showing an inserted connecting member, FIG. 10*b* is a sectional view showing the completely inserted connecting member, and FIG. 11 is a sectional plan view of a modification of the sixth embodiment where the shoulder is obviated.

A core 2 comprises a base 25 and a connecting arm 26 as in the fifth embodiment. On the connecting arm 26, two securing projections 21 are formed, which are provided to be engaged with respective recesses 18, formed in the inner wall of a link 1 at the corresponding positions.

A connecting member 4 comprises a base 41 and a connecting arm 43 as in the fifth embodiment. The connecting arm 43 has an inserting portion 44 and a shoulder 45 at the end thereof.

The base 41 is bent in the direction of the thickness of the band so as to slightly rise from the connecting arm 43. More particularly, the connecting arm 43 is bent at a position halfway of the longitudinal side thereof so as to lift a stopper projection 42. The raised base 41 including a part of the connecting arm 43 is shown as a resilient portion 50.

As shown in FIGS. 8 and 10, in order to impart an effective urging force to the resilient portion 50, an angle a between the connecting portion 4 and the resilient portion 50 is preferably in the range between 8 to 4°. In the present embodiment, the angle is set to 6°, which is the most preferable angle.

Referring to FIGS. 10*a* and 10*b*, the connecting member 4 yields as the resilient portion 50 is urged to lie down by the inner wall of the link 1 so as to be inserted therein. Due to the urging force of the resilient portion 50 which is yielded to be substantially horizontal, the stopper projection 42 is constantly urged toward the underside of the link 1.

When completely inserted, the shoulder 45 abuts against the core 2. At the same time, the urging force of the resilient portion 50 urges the stopper projection 42 to engage with a recess 17.

Meanwhile, the connecting member 4 is adapted so as not to abut against the core 2 except at the shoulder 45. If the connecting member 4 abuts on the core 2 at several portions, the registering of the stopper projection 42 and the recess 17 becomes difficult.

In addition, a recess 51 may be formed in the base 41 of the connecting member 4 to prevent the contact with the core 2.

In order to remove the connecting member 4 from the link 1, the inserting portion 44 of the connecting portion 4 is pushed. Thus, the resilient portion 50 is resiliently yielded so that the stopper projection 42 is easily disengaged from the recess 17. The elastic deformation of the resilient portion 50 is thus effectuated to separate the connecting member 4 from the link 1 with ease.

Especially, the securing force between the stopper recess and the projection is maintained stable without decreasing after repeated engaging and disengaging of the connecting member 4 and the link 1. The reason is that, since the elastic deformation of the resilient portion 50 is effectuated, plastic deformation of the connecting member 4 and abrasion and breaking of the stopper projection 42 can be prevented.

Although the shoulder 45 and the core 2 abuts against each other, in the example shown in FIG. 11, the recess 51 is enlarged so as to prevent the connecting member 4 from abutting against the core 2. Despite such a modification, the operation for securing the connecting member 4 in the link 1 can be performed just as easily. In this structure, the core 2 is prevented from being pushed by the connecting member 4 and falling out of the link 1 so that the reliable engagement between the core 2 and the link 1 is ensured.

In the present invention, the following modifications are possible provided they are within the scope of the subject of the invention.

(1) The inserting portion of the connecting member may be obviated and the arm cut off at the shoulder. In such a case, a blank gap is seen so that there may be an opinion that the appearance of the side of the band is slightly deteriorated. However, the structure is superior in function in that the connecting member can be removed by simply inserting the tool to the end of the gap.

(2) In the case of a band with a large thickness, the inserting passage at the outer side of the core need not be provided. A hole may be formed in the core which blocks the entire opening to provide a passage for inserting the tool.

(3) In the fifth embodiment, the core and the connecting member may be perfectly identical to each other, including the shape and the number of the projections. Hence, either one of the members may be pushed without discriminating one from the other, so that the member which is pushed becomes the connecting member, leaving the member which is not pushed in the link behind.

(4) In the case where the connecting arm is smaller in width than the tubular space in the link as in the fifth embodiment so that the arm may fluctuate at insertion, guide projections may be formed as necessary at the end of the inner wall of the link. Hence the connecting arm can be inserted straight.

PROBABILITY OF INDUSTRIAL EXPLOITATION

In accordance with the present invention, (1) the connecting member is pushed straightforward in the removing direction through the inserting passage formed at the side of the band so that the operation for removing the connecting member can be performed with a small force and at a single operation, and in addition, the band is not damaged by the tool, (2) since the stopper projections and the recesses are provided within the link, the appearance and the feel when worn are improved, (3) the width of the connecting link at the outer side of the link can be decreased, thereby allowing the width of the band to be decreased, and (4) when the recess and the projection for engagement are formed adjacent the line of action of the removing force, the removing force can be further appropriately decreased.

What is claimed is:

1. A link for a band comprising:

a link having at least two annular portions and a connecting portion between the annular portions, an annular connecting link having a gap through which the connecting portion passes and engaged with the connecting portion, an elongated connecting member having a base at an end portion thereof, a connecting arm adjacent the base, and an end side at an opposite side to the base, the connecting member being inserted between the link and the connecting link to connect the connecting link to the link with the connecting arm, stopping means provided on the connecting member and one of the annular portions of the link for holding and stopping the connecting member within the link, and disclosing means for disclosing an outer surface of the end side of the connecting member from one of the annular portions at a lateral side portion of the band, so as to allow a tool to push the connecting member, wherein the connecting arm of the connecting member is bent at an intermediate portion of the arm in a direction of a thickness so that an end thereof abuts on an inner wall of the link.

2. A link for a band comprising:

a link having at least two annular portions and a connecting portion between the annular portions, an annular connecting link having a gap through which the connecting portion passes and engaged with the connecting portion, an elongated connecting member having a base at an end portion thereof, a connecting arm adjacent the base, and an end side at an opposite side to the base, the connecting member being inserted between the link and the connecting link to connect the connecting link to the link with the connecting arm, stopping means provided on the connecting member and one of the annular portions of the link for holding and stopping the connecting member within the link, and disclosing means for disclosing an outer surface of the end side of the connecting member from one of the annular portions at a lateral side portion of the band, so as to allow a tool to push the connecting member, wherein the stopping means comprises means for engaging the connecting member and an inside wall of the annular portions.

3. The link for a band according to claim 2 wherein the recess or the projection formed on one of the annular portion is formed so as to not deform an outer surface thereof.

4. The link for a band according to claim 2 wherein the connecting arm comprises a shoulder and an inserting portion inserted in a tool inserting passage.

5. A link for a band comprising:

a link having at least two annular portions and a connecting portion between the annular portions, an annular connecting link having a gap through which the connecting portion passes and engaged with the connecting portion, an elongated connecting member having a base at an end portion thereof, a connecting arm adjacent the base, and an end side at an opposite side to the base, the connecting member being inserted between the link and the connecting link to connect the connecting link to the link with the connecting arm, stopping means provided on the connecting member and one of the annular portions of the link for holding and stopping the connecting member within the link, and disclosing means for disclosing an outer surface of the end side of the connecting member from one of the annular portions at a lateral side portion of the band, so as to allow a tool to push the connecting member, the disclosing means comprising a core—partially blocking an opening of one of the annular portions at a lateral end portion of the band, so that a tool inserting passage is formed to disclose the outer surface of the end portion.

6. The link for a band according to claim 5 further comprising a core partially blocking an opening of one of the annular portions at a lateral end portion of the band, the core forming at a side thereof a tool inserting passage to disclose the outer surface of the end portion, and the stopping means comprising a recess and a projection which are formed on a side of the base of the connecting member and on an inner wall of the annular portion of the link at a lateral end portion of the band so as to be mutually engaged.

7. The link for a band according to claim 6 wherein the connecting arm comprises a shoulder opposite the core and an inserting portion inserted in the tool inserting passage.

8. The link for a band according to claim 7 wherein the connecting portion stops when the shoulder of the connecting arm abuts against the core, and at the same time, the recess and the projection are engaged with each other.

9. The link for a band according to claim 6 wherein the connecting member substantially has a U-shape having a pair of connecting arms.

10. The link for a band according to claim 9 further comprising a core partially blocking an opening of one of the annular portions at a lateral end portion of the band, the core forming at a side thereof a tool inserting passage to disclose the outer surface of the end portion.

11. The link for a band according to claim 10 wherein the connecting arm comprises a shoulder opposite the core and an inserting portion inserted in the tool inserting passage.

12. The link for a band according to claim 10 wherein the core is secured to one of the annular portions with a securing force larger than a force for securing the connecting member to the link.

13. The link for a band according to claim 5 wherein the connecting arm comprises a shoulder opposite the core and an inserting portion inserted in the tool inserting passage.

14. The link for a band according to claim 5 wherein the core is secured to one of the annular portions with a securing force larger than a force for securing the connecting member to the link.

15. A link for a band comprising;

a link having at least two annular portions and a connecting portion between the annular portions, an annular connecting link having a gap through which the connecting portion passes and engaged with the connecting portion, an elongated connecting member having a base at an end portion thereof, a connecting arm adjacent the base, and an end side at an opposite side to the base, the connecting member being inserted between the link and the connecting link to connect the connecting link to the link with the connecting arm, stopping means provided on the connecting member and one of the annular portions of the link for holding and stopping the connecting member within the link, and disclosing means for disclosing an outer surface of the end side of the connecting member from one of the annular portions at a lateral side portion of the band, so as to allow a tool to push the connecting member, wherein a length of the connecting member is smaller than a length of the link, and the end portion of the connecting arm is retreated from an outer edge of the end annular portion, thereby forming a tool introducing recess.

16. A watch having a band, the band comprising:

a link having at least two annular portions and a connecting portion between the annular portions, an annular connecting link having a gap through which the connecting portion passes and engaged with the connecting portion, an elongated connecting member having a base at an end portion thereof, a connecting arm adjacent the base, and an end side at an opposite side to the base, the connecting member being inserted between the link and the connecting link to connect the connecting link to the link with the connecting arm, stopping means provided on the connecting member and one of the annular portions of the link for holding and stopping the connecting member within the link, and disclosing means for disclosing an outer surface of the end side of the connecting member from one of the annular portions at a lateral side portion of the band, so as to allow a tool to push the connecting member, the disclosing means comprising a core partially blocking an opening of one of the annular portions at a lateral end portion of the band, so that a tool inserting passage is formed to disclose the outer surface of the end portion.

17. A watch having a band, the band comprising:

a link having at least two annular portions and a connecting portion between the annular portions, an annular connecting link having a gap through which the connecting portion passes and engaged with the connecting portion, an elongated connecting member having a base at an end portion thereof, a connecting arm adjacent the base, and an end side at an opposite side to the base, the connecting member being inserted between the link and the connecting link to connect the connecting link to the link with the connecting arm, stopping means provided on the connecting member and one of the annular portions of the link for holding and stopping the connecting member within the link, and disclosing means for disclosing an outer surface of the end side of the connecting member from one of the annular portions at a lateral side portion of the band, so as to allow a tool to push the connecting member, wherein the connecting arm of the connecting member is bent at an intermediate portion of the arm in a direction of a thickness thereof so that and end thereof abuts on an inner wall of the link.

18. A watch having a band, the band comprising:

a link having at least two annular portions and a connecting portion between the annular portions, an annular connecting link having a gap through which the connecting portion passes and engaged with the connecting portion, an elongated connecting member having a base at an end portion thereof, a connecting arm adjacent the base, and an end side at an opposite side to the base, the connecting member being inserted between the link and the connecting link to connect the connecting link to the link with the connecting arm, stopping means provided on the connecting member and one of the annular portions of the link for holding and stopping the connecting member within the link, and disclosing means for disclosing an outer surface of the end side of the connecting member from one of the annular portions at a lateral side portion of the band, so as to allow a tool to push the connecting member, wherein the stopping means comprises means for engaging the connecting member and an inside wall of the annular portions.

19. A watch having a band, the band comprising:

a link having at least two annular portions and a connecting portion between the annular portions, an annular connecting link having a gap through which the connecting portion passes and engaged with the connecting portion, an elongated connecting member having a base at an end portion thereof, a connecting arm adjacent the base, and an end side at an opposite side to the base, the connecting member being inserted between the link and the connecting link to connect the connecting link to the link with the connecting arm, stopping means provided on the connecting member and one of the annular portions of the link for holding and stopping the connecting member within the link, and disclosing means for disclosing an outer surface of the end side of the connecting member from one of the annular portions at a lateral side portion of the band, so as to allow a tool to push the connecting member, wherein a length of the connecting member is smaller than a length of the link, and the end portion of the connecting arm is retreated from an outer edge of the end annular portion, thereby forming a tool introducing recess.

* * * * *